US007562475B2

(12) United States Patent
Konig et al.

(10) Patent No.: US 7,562,475 B2
(45) Date of Patent: Jul. 21, 2009

(54) EMBROIDERY HOOP WITH A TENSIONING DEVICE

(75) Inventors: Michael Konig, Constance (DE); Thomas Guggisberg, Boswil (CH)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 12/038,191

(22) Filed: Feb. 27, 2008

(65) Prior Publication Data

US 2008/0229629 A1 Sep. 25, 2008

(30) Foreign Application Priority Data

Mar. 20, 2007 (CH) ..... 00444/07

(51) Int. Cl.
*D06C 3/08* (2006.01)
*D05C 9/04* (2006.01)

(52) U.S. Cl. ..... 38/102.2; 112/103

(58) Field of Classification Search ..... 38/102, 38/102.1, 102.2, 102.4, 102.91; 112/103
See application file for complete search history.

(56) References Cited

U.S. PATENT DOCUMENTS

| | | | | | |
|---|---|---|---|---|---|
| 272,826 | A * | 2/1883 | Young | 72/292 |
| 519,258 | A * | 5/1894 | Hill | 38/102.2 |
| 629,847 | A | 8/1899 | Doolittle | |
| 1,059,143 | A * | 4/1913 | Gibbs | 38/102.2 |
| 3,855,718 | A * | 12/1974 | Parsons et al. | 38/102.2 |
| 6,968,792 | B2 * | 11/2005 | Hori | 112/103 |

FOREIGN PATENT DOCUMENTS

| | | |
|---|---|---|
| DE | 3130882 | 4/1982 |
| DE | 29508369 | 9/1995 |

* cited by examiner

*Primary Examiner*—Ismael Izaguirre
(74) *Attorney, Agent, or Firm*—Volpe and Koenig, P.C.

(57) ABSTRACT

A tensioning device (11) is arranged on an embroidery hoop (1), which allows the tensioning of the outer frame (3) with a turning knob (33). For protection from damage, a ratchet (37) is inserted in the turning knob (33) and for simple opening after the end of the embroidery process, a free wheel (45) is inserted.

9 Claims, 4 Drawing Sheets

EMBROIDERY HOOP WITH A TENSIONING DEVICE

CROSS-REFERENCE TO RELATED APPLICATIONS

This application claims the benefit of Swiss Patent Application No. 00444/07, filed Mar. 20, 2007, which is incorporated herein as if fully set forth.

BACKGROUND

The invention relates to an embroidery hoop with at least one tensioning device.

Embroidery hoops are used for tensioning a textile planar structure, e.g., a fabric, to be embroidered. Such embroidery hoops are used for hand stitching usually as circular rings. When stitching planar structures on special embroidery machines or on sewing machines, the embroidery hoops usually have a rectangular shape with rounded edges. The tensioning of the embroidery material in a non-circular embroidery hoop requires higher tensioning forces, especially when the embroidery hoop exceeds a certain size. Therefore, a plurality of tensioning devices are already known.

In an embroidery hoop known from U.S. Pat. No. 629,847, the tensioning, i.e., the tightening of the outer embroidery hoop, is performed with a toggle lever. For such an embroidery hoop, the length of the tensioning traverse is extremely limited and consequently is suitable only for embroidery hoops with small circumference.

From DE 31 30 882, another embroidery hoop is known, in which the two ends on the open, outer hoop can be tightened by a screw. The tangential screw is troublesome to operate when it is to be turned for tensioning.

To lessen the disadvantage of the tensioning device above, from DE 295 08 369 a tensioning device is known, in which the tensioning screw is arranged so that it can pivot outwards, in order to make its accessibility and operation or turning easier.

In the known tensioning devices on embroidery hoops, the latter must be lifted or picked up off a contact surface, in order to be able to handle the tensioning device. This means that the embroidery hoop must be held with one hand and the tensioning screw must be actuated with the other hand. This is involved and an exact placement of the embroidery material is complicated.

SUMMARY

One objective of the present invention is to provide an embroidery hoop with a tensioning device, which is easy to handle and in which the embroidery material can be positioned in the embroidery hoop without any trouble after placement in the embroidery hoop.

The embroidery hoop of the present invention allows for such easy handling. Advantageous constructions of this embroidery hoop are described below and in the claims.

Advantageously, through the arrangement of the rotational axis of the tensioning device perpendicular to the surface of the embroidery material in the embroidery hoop, it is possible to simplify its operation. The embroidery hoop does not have to be picked up from a contact surface, in order to position and/or tension embroidery material in the frame. The inner frame can simply be placed under or over the embroidery material, the outer frame is then stacked on top, so that the embroidery material comes to lie between the inner and outer frames. Then the embroidery material is pre-positioned by hand by pressing together the two open ends of the outer frame. After the subsequent definitive positioning, the frame is tensioned by a very small rotation of a turning knob. Overload protection prevents the destruction of the tensioning device for improper handling or for too high a torque on the turning knob. A device for quickly and also completely removing the tensioning simplifies further work on an adjacent surface of the embroidery material still to be stitched and when unclamping the embroidery material.

In addition to the tensioning being released, the outer frame is completely expanded by the quick release of tension. In this way, then embroidery material with a greater thickness or greater stiffness can also be inserted, without the frame also having to be pulled apart.

BRIEF DESCRIPTION OF THE DRAWINGS

The invention is explained in more detail below with reference to a preferred exemplary embodiment. In the drawings.

DETAILED DESCRIPTION OF THE PREFERRED EMBODIMENT

Figure 1:
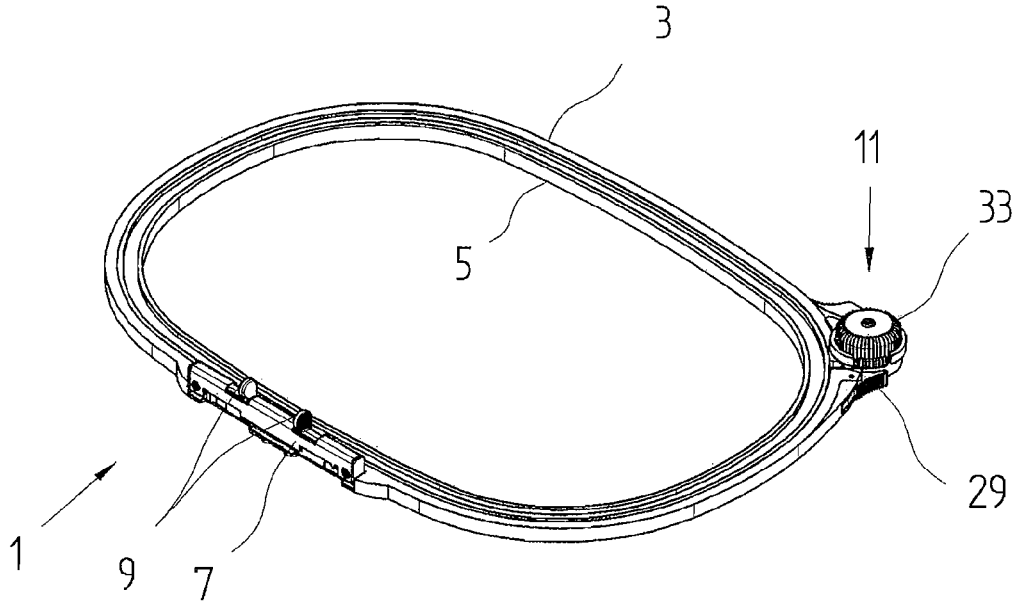
FIG. 1 is a perspective view of the embroidery hoop without embroidery material.
Figure 2:
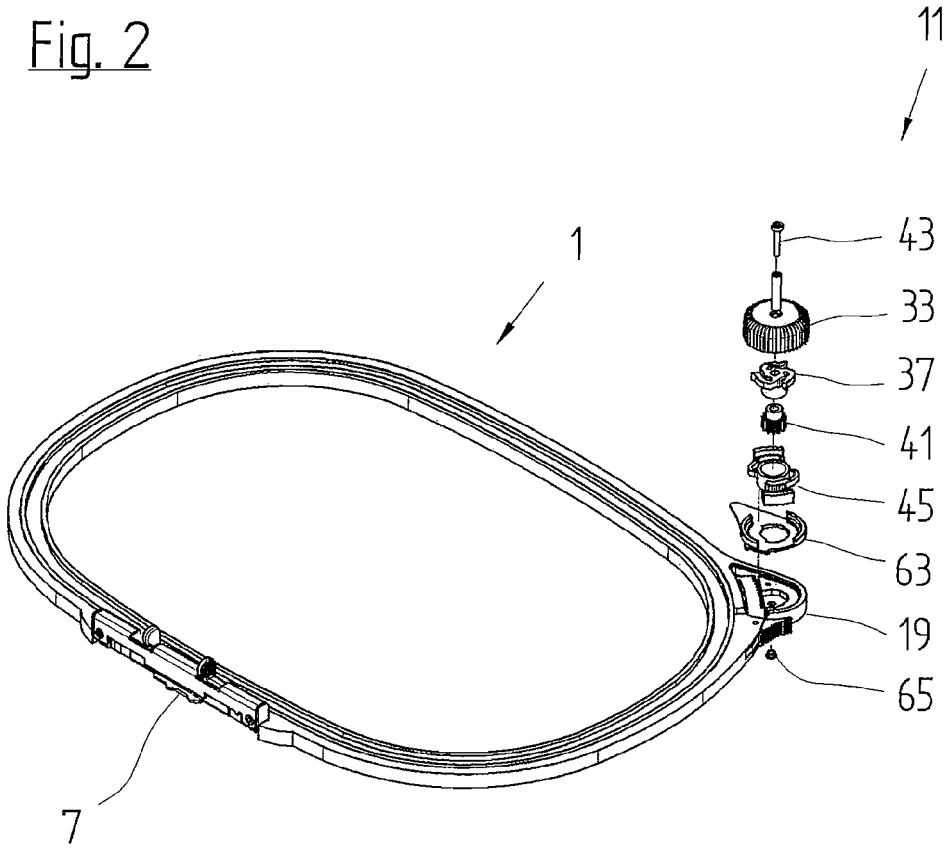
FIG. 2 is a perspective view of the embroidery hoop with individual elements of the tensioning device shown in an exploded view above the embroidery hoop.

The embroidery frame designated with the reference symbol 1 includes an outer frame 3 and an inner frame 5. The embroidery hoop 1 can have, as shown in the figures, a rectangular shape with rounded corners; however, it can also have an oval or circular construction (no illustration). The construction or cross sections of the frames 3, 5 are known from the state of the art. The frames 3, 5 are shaped such that embroidery material (not shown) placed around the periphery of the closed inner frame and set in contact with the inner periphery of the outer frame 3 can be clamped tight without sliding, once the outer frame 3 is tightened with a tensioning device 11 from an expanded position into the work position.

Figure 4:
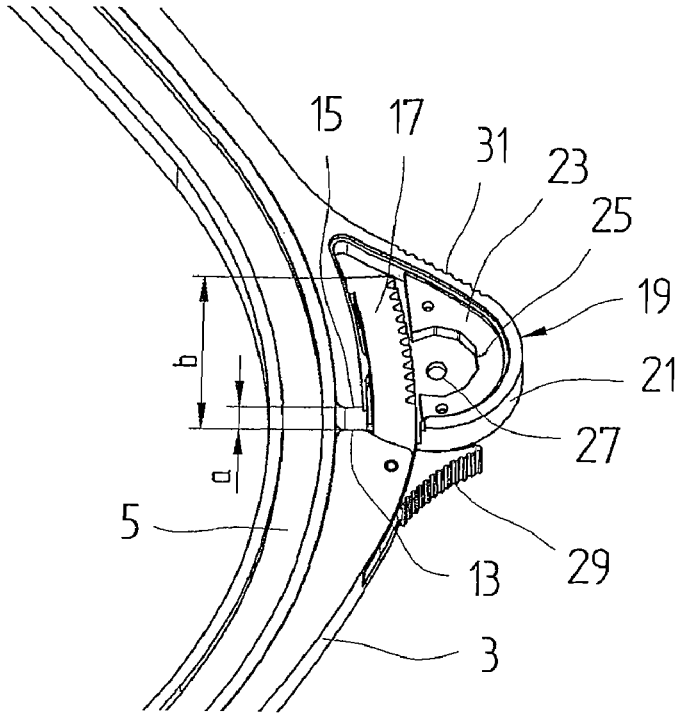
FIG. 4 is an enlarged view of a portion of the outer frame in the region of the tensioning device.

On the outer frame 3, a fastening device 7 for attaching the embroidery hoop 1 to a drive device of a sewing or embroidery machine (not shown) is visible on the left side. The two tabs 9 projecting upward are used to be able to detach the embroidery hoop 1 from the drive device without a tool. The outer frame 3 is divided on the right side, where the tensioning device 11 is visible. By separating the outer frame 3, its periphery can be changed. The two open ends 13 and 15 of the outer frame 3 are spaced apart at a mutual distance a from each other. An arc segment-shaped toothed rack 17 is fastened to the end 13 of the frame 3 at the bottom in FIG. 4 and projects by an amount b past the end 13 and preferably into the region of the second end 15 on the outer frame 3. At the top end 15 of the frame 3, a plate 19 is formed, on which the tensioning device 11 can be placed. The plate 19 includes a collar 21 following its arc-shaped contours and a polygonal recess 25 as well as a borehole 27 in the surface 23 of the plate 19.

A ramp-shaped first grip plate 29 is formed peripherally on the bottom, open end 13 of the outer frame 3. Grip ribbing 31 that is complementary to the grip plate 29 is formed on the periphery of the plate 19 on the top end 15.

Figure 3:
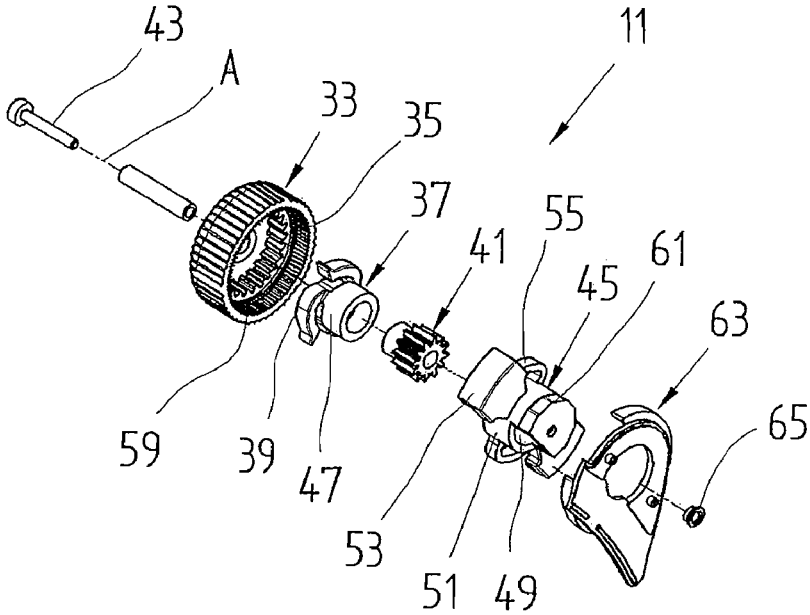
FIG. 3 is an enlarged view of the tensioning elements.
Figure 5:
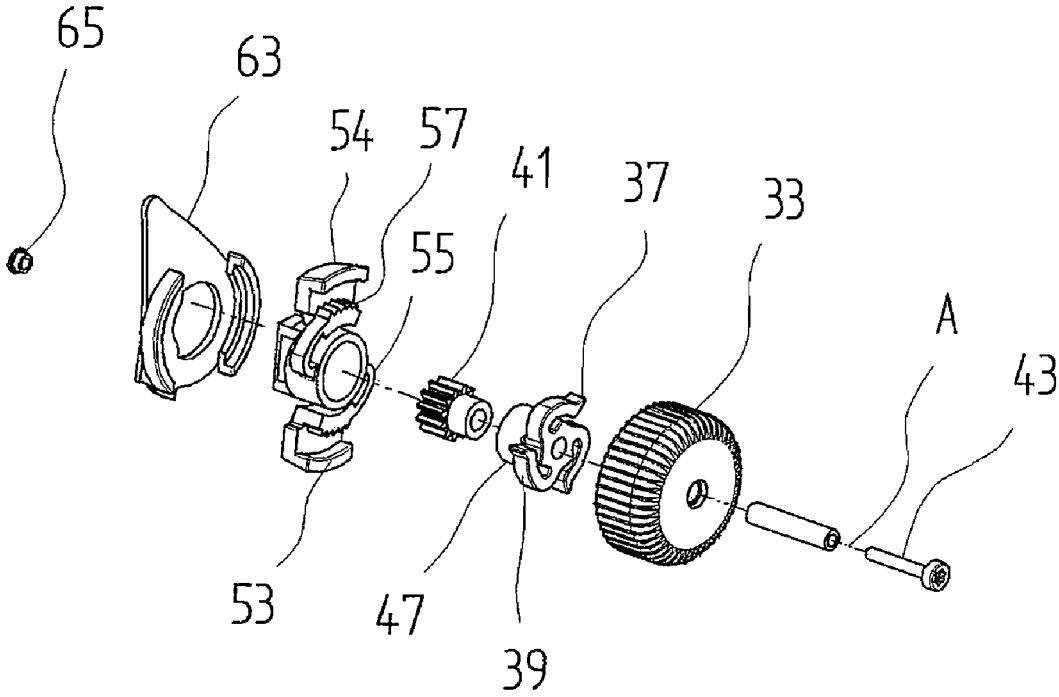
FIG. 5 is an enlarged view of the tensioning elements as in FIG. 3, but rotated by 180°.

Furthermore, in FIGS. 3 and 5, the tensioning device 11 is visible in an exploded view. This includes a turning knob 33 with a periphery that is ribbed or that is made easy to grip in some other way and with first internal teeth 35 (cf. FIG. 3). A ratchet 37, which includes, for example, three elastic ratchet arms 39 that act as a torque coupling, is located in the interior of the turning knob 33. The torque coupling fixes the maximum possible torque, with which the two frames are tensioned to each other. The ratchet arms 39 engage with the first internal teeth 35. The ratchet 37 is locked in rotation with a pinion 41, which is led into meshing engagement with the toothed rack 17 when the tensioning device 11 is fastened in the plate 19. Furthermore, on the same axis A, formed by a threaded pin 43, which penetrates both the turning knob 33 and also the ratchet 37 and the pinion 41, a free wheel 45 is mounted. In the mounted state, this free wheel wraps around both the cylindrical tube-shaped section 47 on the ratchet 37 and also the pinion 41. The teeth of the pinion 41 then projects from an opening formed on the free wheel 45. The opening 49 has, in cross section, the shape of a circular section, so that (in the assembled state), approximately a third of the teeth of the pinion 41 are visible. Two diagonally opposite cheeks 53 offset in the axial direction to the opening 49 are hung on elastic arc-shaped profiles 55 on the cylindrical housing 51 of the free wheel 45. The arc-shaped profiles 55 are formed on the ends of the cheeks 53 and have teeth 57 projecting outward in the radial direction in the region of the cheeks 53. When the free wheel 45 is pushed into the turning knob 33, these teeth are led into meshing and thus positive-fit engagement with second internal teeth 59 in the turning knob 33. The second internal teeth 59 have a greater diameter than the first internal teeth 35 adjacent in the axial direction. Furthermore, a polygonal shaft stub 61, which comes to lie on the plate 19 in the polygonal recess 25, is formed offset to the cheeks 53 in the axial direction on the free wheel 45, whereby the free wheel 45 can be locked in rotation with the plate 19. In addition, a cover 63 can be located on the plate 19, which covers the elements of the ratchet 37, pinion 41, and free wheel 45 in the mounted state. The tensioning device 11 is fastened using a screw nut 65 to the plate 19.

Below the function of the tensioning device 11 on the embroidery hoop 1 is explained in more detail.

After the placement of a base of the embroidery material in the embroidery hoop 1, i.e., the base of the embroidery material is placed over the inner frame 5 and the outer frame 3 is then stacked on top or vice versa, then the outer frame 3 can be pressed together with two fingers on the grip plate 29 and the grip ribbing 31 and a first moderate clamping force can be generated between the inner and outer frame. In this way, however, the embroidery material is not yet completely tensioned, but instead it is held in position. This is helpful for subsequent exact positioning of the embroidery material within the embroidery hoop 1. Alternatively, the same effect can be achieved by turning the rotary knob 33 somewhat. By rotating the rotary knob 33, the pinion 41, which meshes with the toothed rack 17, pushes the lower end 13 of the outer tensioning frame 3 against the top end 15. In other words: the outer frame 3 is pulled together and lies flat on the base of the embroidery material and the periphery of the inner frame 5. After successful definitive positioning of the embroidery material, the turning knob 33 is turned further and therefore the tension increases. When turning the rotary knob 33 in the clockwise direction, a soft clicking noise is audible. This is caused by the two profiles 55 of the free wheel 45. Because the free wheel 45 is connected with a positive fit to the outer frame 3 via the polygonal shaft stump 61, the latter cannot rotate, which is why the teeth 57 on the profile 55 jump out at the second internal teeth 59. However, automatic detachment of the turning knob 33 and thus the release of tension in the outer frame 3 are prevented. So that the turning knob 33 and other parts cannot be overloaded when the maximum possible tension of the outer frame 3 on the inner frame 5 is reached, the ratchet arms 39 begin to jump on the first inner teeth 35. This is indicated by a loud clicking noise. The rotational movement of the turning knob 33 is therefore ineffective or a greater torque cannot be transferred. Now, the embroidery frame 1 is ready for the stitching of the sewing material or the base of the embroidery material.

After the end of the embroidery process, by pressing the cheeks 53 together in the radial direction, the tension of the outer frame 3 on the inner frame 5 or the embroidery material clamped tight in-between can be detached abruptly. When the cheeks 53 are pressed together, the teeth 57 are guided inward on the profile 55 in the radial direction and therefore the positive fit with the second teeth 59 on the turning knob 33 is canceled. Through the tensioning force exerted on the inner frame 5, the turning knob 33 turns back and with this also the pinion 41, which leads to the two ends 13 and 15 moving apart. For supporting the reverse rotational movement, between the toothed rack 17 and the part of the outer frame 3 not connected to this rack, a spring can also be inserted (not visible). Alternatively, a spiral spring could obviously also be placed on the free wheel, which engages with a beveled end in the second inner teeth 59 on the turning knob 33 (not shown).

Figure 6:
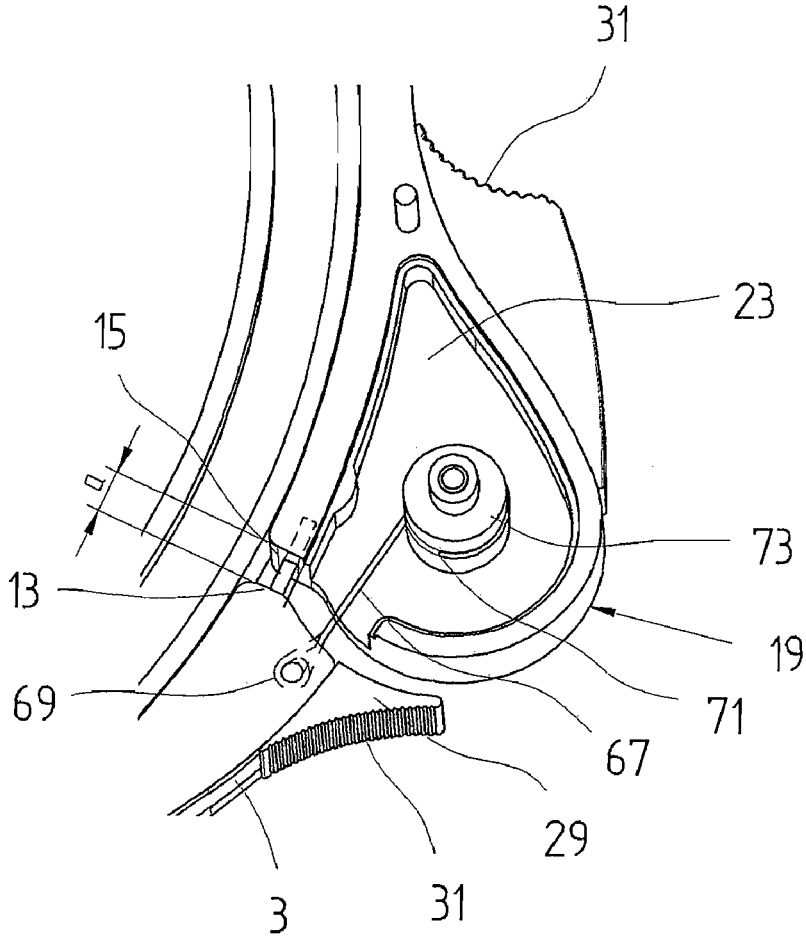
FIG. 6 is an enlarged view of a portion of the outer frame in the region of the tensioning device without turning knob in another construction of the invention.

In the construction of the invention according to FIG. 6, an elongated tension element 67, e.g., a flexible cable, takes the place of a toothed rack, with which a pinion meshes. Instead of a cable made from wire or plastic, a belt made from metal or plastic could also be used. One end 69 of the tension element 67 is fastened to the lower end 13 of the outer frame 3. The attachment can be realized by means of a loop-hook connection according to FIG. 6.

Obviously, other types of connections, such as, for example, adhesives, etc., are also possible. The second end 71 of the tension element 67 is fastened to the periphery of a coil disk 73. This takes the place of the pinion 41 in the first embodiment. The remaining elements of the tensioning device 11 remain unchanged. In the interior of the coil disk 73, a tension spring not visible in FIG. 6 can be inserted, which always keeps the tension element 67 under slight tension, but which has no effect on the distance a between the two ends 13, 15 of the outer frame 3.

Figure 7:
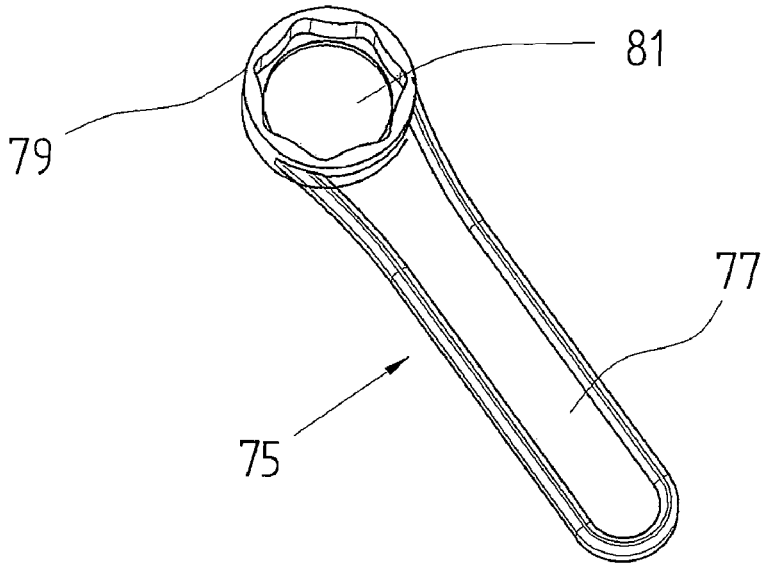
FIG. 7 is a perspective view of an auxiliary wrench for turning the tensioning screw.

In FIG. 7, an auxiliary wrench 75 is shown, which is used for turning the turning knob 33 if the force of the operator is not adequate for sufficiently increasing the tension. The auxiliary wrench 75 includes a handle 77 and a head 79, wherein a toothed recess 81 is arranged in the head 79, whose shape is congruent to the jacket of the turning knob 33. Alternatively or additionally, a ratchet mechanism and/or a torque limiter can be inserted in the head 79 of the auxiliary wrench 75.

| Legend | |
|---|---|
| 1 | Embroidery hoop |
| 3 | Outer frame |
| 5 | Inner frame |
| 7 | Fastening device |
| 9 | Tabs |
| 11 | Tensioning device |
| 13 | End |
| 15 | End |
| 17 | Toothed rack |
| 19 | Plate |
| 21 | Collar |
| 23 | Surface of 19 |
| 25 | Recess |
| 27 | Borehole |
| 29 | Grip plate |
| 31 | Grip ribbing |
| 33 | Turning knob |
| 35 | First inner teeth |
| 37 | Ratchet |
| 39 | Ratchet arm |
| 41 | Pinion |
| 43 | Pin |
| 45 | Free wheel |
| 47 | Cylinder |
| 49 | Opening |
| 51 | Housing |
| 53 | Cheek |
| 55 | Profile |
| 57 | Teeth |
| 59 | Second inner teeth |
| 61 | Multi-sided shaft stub |
| 63 | Cover |
| 65 | Nut |
| 67 | Tension element |
| 69 | 1st end of 67 |
| 71 | 2nd end of 67 |
| 73 | Coil disk |
| 77 | Handle |
| 79 | Head |
| 81 | Recess |

The invention claimed is:

1. Embroidery hoop (1) with at least one tensioning device (11), comprising a closed inner frame (5) and an outer frame (3) that is open in at least one position and a turning knob (33) arranged on the outer frame (3), with which two open ends (13, 15) of the outer frame (3) can be tightened around the inner frame (5), an elongated tension element (17) is arranged as a tensioning element on the first open end (13) and a rotatable tensioning element that can be locked and that engages the elongated tension element (17) is arranged on the second open end (15), the elongated tension element comprises a toothed rack (17) on the first end (13) and the rotatable tensioning element comprises a toothed pinion (41) arranged on the second end (15) that can rotate and be locked with the toothed rack, and the pinion (41) is locked in rotation with a ratchet (37), which acts as an overload protection.

2. Embroidery hoop according to claim 1, wherein the elongated tension element (17) comprises a rollable cord or a cable or a rollable belt made from plastic or metal fastened on one side on the first open end (13) which has a second end that engages with the rotatable tensioning element that comprises a coil disk (73).

3. Embroidery hoop according to claim 2, wherein the rollable tension element (67) is held on a coil disk (73) so that it can be wound and unwound.

4. Embroidery hoop according to claim 3, wherein the coil disk (73) is connected to a ratchet (37).

5. Embroidery hoop according to claim 1, wherein the ratchet (37) is supported on a rotational axis (A) formed by a pin (43) in a turning knob (33).

6. Embroidery hoop according to claim 5, wherein ratchet arms (39) on the ratchet (37) engage in first inner teeth (35) in the turning knob (33).

7. Embroidery hoop according to claim 5, wherein a free wheel (45) is then arranged in an axial direction on the pinion (41) or the coil disk, on whose periphery two arc-shaped profiles (55) are attached with teeth (57) and with cheeks (53), wherein the teeth (57) can be brought into engagement with second inner teeth (59) on the turning knob (33) and can be brought out of engagement with the turning knob (33) by the cheeks (53) being in a second, pressed together position, which causes a quick release of tension in the starting position.

8. Embroidery hoop according to claim 7, wherein a restoring spring attaches to the coil disk (73).

9. Embroidery hoop according to claim 8, wherein the restoring spring can be tensioned by tensioning the outer frame (3).

* * * * *